US006368361B1

(12) United States Patent
Yayabe et al.

(10) Patent No.: US 6,368,361 B1
(45) Date of Patent: Apr. 9, 2002

(54) MANUFACTURING PROCESS OF ANTIBACTERIAL FIBER

(75) Inventors: Fumihisa Yayabe; Yasuhiko Ikegawa, both of Shizuoka; Shuichi Takahashi, Tokyo; Yukiko Nonaka, Shizuoka; Saburo Sugimoto, Shizuoka; Kazuhiko Hayashi, Shizuoka; Yuji Higashibata, Shizuoka, all of (JP)

(73) Assignee: Ito En, Ltd., Tokyo (JP)

( * ) Notice: Subject to any disclaimer, the term of this patent is extended or adjusted under 35 U.S.C. 154(b) by 0 days.

(21) Appl. No.: 09/532,897

(22) Filed: Mar. 22, 2000

(30) Foreign Application Priority Data

May 18, 1999 (JP) ..... 11-136949

(51) Int. Cl.[7] ..... D06M 13/322; C09B 67/10; D06P 5/22

(52) U.S. Cl. ..... 8/490; 8/495; 8/606; 8/613; 8/595; 8/115.56; 8/115.65; 8/181; 8/188; 8/930; 8/646

(58) Field of Search ..... 8/490, 495, 606, 8/613, 595, 115.56, 188, 115.65, 646, 181, 930

(56) References Cited

U.S. PATENT DOCUMENTS 5,610,189 A * 3/1997 Whiteley

FOREIGN PATENT DOCUMENTS

JP 6-173176 * 6/1994

* cited by examiner

*Primary Examiner*—Margaret Einsmann
(74) *Attorney, Agent, or Firm*—Sughrue Mion, PLLC

(57) ABSTRACT

Tea polyphenol obtained by the extraction from tea has an antibacterial effect. In methods for producing an antibacterial fiber by fixing the tea polyphenol to fiber, the object of the present invention is to provide a process for manufacturing an antibacterial fiber capable of exerting an excellent antibacterial performance without the use of metal chelates potentially causing metal allergy and environmental problems. In order to achieve the above object, the present invention manufactures an antibacterial fiber by a process comprising the steps of contacting fiber with or immersing fiber in an aqueous solution in which a cationic surfactant with a quaternary ammonium salt group, a water-soluble protein, and an alkaline compound are dissolved; and separating said fiber from the aqueous solution, to immerse the fiber in another aqueous solution containing tea polyphenol.

19 Claims, No Drawings

MANUFACTURING PROCESS OF ANTIBACTERIAL FIBER

BACKGROUND OF THE INVENTION

1. Field of the Invention

The present invention relates to a process for manufacturing an antibacterial fiber to which tea polyphenol obtained by the extraction from tea is fixed.

2. Related Art Statement

Tea polyphenol obtained by the extraction from tea is known to have an antibacterial property. Antibacterial fiber textile products utilizing such an antibacterial property were disclosed in, for example, Japanese Patent Laid-open Publication Nos. Hei 8-296173 and Hei 10-37070.

Methods for fixing tea polyphenol to fiber were disclosed, for example, in Japanese Patent Laid-open Publication Nos. Sho 58-115178, Hei 3-19985, Hei 6-173176, and Hei 9-316786.

However, it cannot be said that these fixing methods previously proposed were able to give sufficiently such an antibacterial effect possessed by tea polyphenol. In addition, since many of these proposed methods use metal chelates as mordants, metal allergy is likely to be caused by some kinds of these metals, also there is a possibility that environmental problems are caused by disposing of production effluents and fibers themselves.

OBJECT AND SUMMARY OF THE INVENTION

The object of the present invention is to provide a process for manufacturing an antibacterial fiber capable of sufficiently exerting an antibacterial effect possessed by tea polyphenol without using metal chelates.

In order to achieve the above object, the present invention is to manufacture an antibacterial fiber by a process comprising the steps of contacting fiber with or immersing fiber in an aqueous solution in which a cationic surfactant with a quaternary ammonium salt group, a water-soluble protein, and an alkaline compound are dissolved (step (1)); and separating the fiber from the aqueous solution to immerse the fiber in another aqueous solution containing tea polyphenol (step (2)).

According to this manufacturing process, tea polyphenol can be fixed to any fiber without using metal chelates. The resultant fiber has an enhanced color fastness and a small decrease in color fastness after repeated washing, and also exhibits an extremely superior antibacterial effect.

Not all reasons are clear why the process of the present invention can give such an effect. It is, however, likely that in step (1), the interaction between the cationic surfactant and the water-soluble protein forms dyeing sites in the fiber structure, and in the subsequent step (2), the tea polyphenol is captured at the dyeing sites to fix to the fiber.

DESCRIPTION OF THE PREFERRED EMBODIMENT

A preferred embodiment according to the present invention is described as follows.

Fiber subjected to the manufacturing process of the present invention includes a fiber or a mixture of two or more fibers selected from the group consisting of, for example, a natural, chemical, synthetic, and regenerated fiber, and specifically, a cellulose fiber, an animal fiber, a polyester fiber, an acetate fiber, a nylon fiber, an acrylic fiber, a rayon fiber, a polypropylene fiber, a polyvinyl chloride fiber, and polyurethane fiber. Preferably, a natural fiber is selected in terms of its texture, touch, and safety. The fiber may be an unwoven fiber itself or a textile structure formed by knitting or weaving. The present invention can be applied to any textile goods including, for example, living goods such as clothes, bedclothes, and towels for the elderly and children with a reduced immunity or resistance, as well as for normal persons, to provide a safe and comfortable life.

Fiber is optionally scoured and bleached according to conventional procedures before being subjected to step (1).

In step (1), there is prepared an aqueous solution in which a cationic surfactant with a quaternary ammonium salt group, a water-soluble protein, and an alkaline compound are dissolved, and then the fiber is contacted with or immersed in this aqueous solution.

A cationic surfactant with a quaternary ammonium salt group can be, for example, a fatty acid salt of $C_{8-18}$-alkyl amine, mono($C_{8-18}$-aikyl)trimethylammonium halide, di($C_{8-18}$-alkyl)dimethylammonium halide, ($C_{8-18}$-alkyl) pyridinium halide, ($C_{8-18}$alkyl)benzyldimethylammonium halide, or acetate and propionate salts, and the halide can include chloride and bromide. The cationic surfactant is adjusted to contain preferably 1 to 5% by weight, and more preferably 3 to 5% by weight, in the aqueous solution.

The water-soluble protein is not limited in its type, as long as it is soluble in water, and can be, for example, silk protein. The water-soluble protein is adjusted to contain preferably 8 to 40% by weight, and more preferably 20 to 40% by weight, in the aqueous solution.

As the alkaline compound hydroxide, hydogencarbonate, or carbonate of an alkali metal, such as sodium hydroxide, hydogencarbonate, or carbonate can be preferably employed. In particular, sodium hydroxide is preferred.

The amount of the alkaline compound varies depending on the type of the fiber to be treated, and is preferably adjusted to contain the alkaline compound at 0.1 to 5% by weigh in the aqueous solution. For example, when a cellulose fiber is treated, the alkaline compound is preferably adjusted to contain 4.5 to 5% by weight.

In the treatment in step (1), it is preferable that depending on the type of the fiber, the treating solution is heated at a temperature of about 20 to 100° C., to immerse the fiber in this solution for 1 to 100 minutes, and more preferably 10 to 60 minutes. For example, the immersion is carried out for 30 minutes in the treating solution at 80° C., or for 8 hours at about 20° C. In the latter case, the immersion is preferable carried out by a cold batch process, which can result in much more enhancement in the property of fixing tea polyphenol. Alternatively, depending on the type of the fiber, this treatment may be successfully carried out by simply contacting the fiber with the treating solution, for example, by sprinkling, applying, or spraying it, instead of immersing the fiber in the treating solution. In such cases, it is preferable that the fiber is continuously contacted for 1 to 60 minutes with the treating solution heated at about 20 to 100° C.

After the treatment in step (1), the fiber is removed off, i.e., separated from the treating solution, and when needed, dehydrated or dried, and then subjected to the next treatment in step (2).

In step (2), the fiber is immersed in an aqueous solution containing tea polyphenol.

As tea polyphenol an extract from at least one tea selected from the group consisting of Japan tea, China tea, green tea, black tea, oolong tea, jasmine tea, Pu-erh tea, which are derived from tea plants of *Camellis sinesis L.* can preferably be employed. Said extract can be an extract obtained by extracting said tea with water or a hydrophilic organic solvent or a mixture thereof, or in addition, a preparation obtained by purifying such an extract with an adsorbent resin, or a further preparation obtained by fractional extracting such a preparation with a hydrophobic organic solvent such as chloroform, ethyl acetate, methyl isobutyl ketone, or the like. Among them, a desirable extract or preparation has a high content of tea catechins, particularly epigallocatechin gallate. Specifically, it is preferable to employ tea polyphenol obtained by methods described in Japanese Patent No. 2703241, Japanese Paten Laid-open Publication Nos. Hei 2-311474, Hei 4-182479, Hei 4-182480, Hei 6-9607, and Hei 7-70105. In addition, commercial available tea polyphenol can be also used, such as THEA-FLAN 30A or 90S, which are made by Ito En Ltd. (Tokyo, Japan) and contain 40% or 90% of green tea polyphenol, respectively.

The tea polyphenol, as above-mentioned extract, is preferably contained at 1 to 30 parts by weight per 100 parts of the aqueous solution by weight, based on the solid materials in the treating solution. With respect to the weight of fiber, the tea polyphenol is preferably contained at 0.1 to 20% by weight, in particular 0.5 to 5% by weight. In some cases, the content is preferably adjusted so that said epigallocatechin gallate, in particular, is dissolved at a high concentration of 5% by weight or higher. The tea polyphenol solution is preferably adjusted at pH 3 to 11, particularly pH 6 to 9.

In step (2), it is preferable to heat the treating solution at 20 to 90° C., and more preferably at about 40 to 60° C., in which the fiber is immersed for 1 to 100 minutes, and more preferably for 10 to 60 minutes. For example, the immersion for 40 minutes in the treating solution at 60° C. is a desirable treating condition.

The treatment in step (2) may be also carried out in the co-existence of tea polyphenol and a dye, wherein the dye is added to the treating solution, i.e., a solution of tea polyphenol. When the fiber is immersed in an aqueous solution containing tea polyphenol and a dye, the fixation of tea polyphenol and the dyeing by the dye can take place simultaneously, providing a desirable color for the fiber.

A dye employed in this step is not limited in particular, and can include, for example, a direct dye, an acid dye, a reactive dye, a disperse dye, an oxidation dye, a food dye, a pigment resin, and the like.

In the absence of such a dye, however, it is possible to change textures of the fiber to some extent by varying the type and/or the concentration of the tea polyphenol used.

After the treatment in step (2), a post-treatment is preferably applied to the fiber. In a post-treatment it is preferable to immerse the fiber in an aqueous solution in which for example hydroxycarboxylic acid suchlas tartaric, citric, or malic acid is dissolved, or to add said hydroxycarboxylic acid to the treating solution i.e., the tea polyphenol solution after the treatment in step (2), and continue the immersion, whereby the reaction system is neutralized to promote and strengthen the fixation of the tea polyphenol.

A dye may be added in the post-treatment, instead of adding a dye in step (2).

Finally, the fiber is finished by immersing with running water, dehydration, drying, and the like according to conventional procedures.

The such obtained fiber is found to exhibit an antibacterial property against *Staphylococcus aureus, Pseudomonas aeruginosa, Escherichia coli, Klebsiella pneumoniae*, and the like. In particular, it is worthy of notice that the fiber according to the present invention exhibits an antibacterial property against methicillin resistance *Staphylococcus* aureus (MRSA), which has been the matter in recent nosocomial infections. The fiber according to the present invention, therefore, is expected to be able to reduce nosocomial infections by treating, for. example, bedcovers and others in hospitals. In addition, the antibacterial fiber obtained by the process of the present invention can be said to be highly safe to human bodies, since the antibacterial fiber according to the present invention employs, as the antibacterial agent, tea polyphenol which has been found to be safe to human bodies unlike silver-based materials or others, and furthermore, does not utilize metal chelates.

The present invention is illustrated by means of the following examples.

EXAMPLE 1

25 g sodium hydroxide was dissolved in 3 L water and 100 g of a cationic surfactant containing protein (CIHONTEC Co.) was added thereto. This treating solution was heated at 80° C., into which 100 g of towel (cotton) was placed and immersed for 30 minutes with stirring.

The towel was removed from the treating solution and dehydrated, and then immersed for 5 minutes in tea polyphenol solution which was prepared by dissolving 90 g of THEA-FLAN 30A (Ito En, Ltd., 40% of green tea polyphenol content) in 3 L water and heated at 80° C.

The towel was then immersed for 3 minutes in an aqueous solution of 30 g tartaric acid in 300 ml water.

An antibacterial towel containing green tea polyphenol was obtained by removing the towel from the aqueous solution, immersing with running water, dehydrating, and drying.

EXAMPLE 2

25 g sodium hydroxide was dissolved in 3 L water and 100 g of a cationic surfactant containing protein (C.S.P. Co.) was added thereto. This treating solution was heated at 80° C., into which 100 g of towel (cotton) was placed and immersed for 30 minutes with stirring.

The towel was removed from the solution and dehydrated, and then immersed for 5 minutes in an aqueous solution at 80° C. which was prepared by dissolving 1000 g of a oolong tea concentrate (Ito En, Ltd., Brix 15, 3.5% of tea polyphenol content) in 3 L water.

The towel was then immersed for 3 minutes in an aqueous solution of 30 g tartaric acid in 300 ml water.

An antibacterial towel containing oolong tea polyphenol was produced by removing the towel from the aqueous solution, immersing with running water, dehydrating, and drying.

EXAMPLE 3

25 g sodium hydroxide was dissolved in 3L water and 100 g of a cationic surfactant containing protein (C.S.P. Co.) was added thereto. This treating solution was heated at 80° C., into which 100 g of socks were placed and immersed for 30 minutes with stirring.

The socks were removed from the solution and dehydrated, and then immersed for 5 minutes in tea polyphenol solution which was prepared by dissolving 30 g of THEA-FLAN 30A (Ito En, Ltd., 40% of green tea polyphenol content) in 3L water and heating the same at 80° C.

The towel was then immersed for 3 minutes in an aqueous solution of 30 g tartaric acid in 300 ml water.

Antibacterial socks containing green tea polyphenol were produced by removing the socks from the aqueous solution, immersing with running water, dehydrating, and drying.

EXAMPLE 4

25 g sodium hydroxide was dissolved in 3 L water and 100 g of a cationic surfactant containing protein (C.S.P. Co.) was added thereto. This treating solution was heated at 80° C., into which 100 g of socks were placed and immersed for 30 minutes with stirring.

The socks were removed from the solution and dehydrated, and then immersed for 5 minutes in tea polyphenol solution which was prepared by dissolving 150 g of THEA-FLAN 30A (Ito En, Ltd., 40% of green tea polyphenol content) in 3 L water and heated at 80 ° C.

The towel was then immersed for 3 minutes in an aqueous solution of 30 g tartaric acid in 300 ml water.

Antibacterial socks containing green tea polyphenol were produced by removing the socks from the aqueous solution, immersing with running water, dehydrating, and drying.

Table 1 shows the results of the antibacterial activity obtained by examining antibacterial properties of the towel and socks produced in the above-described Examples 1 to 4.

The examination was carried out in accordance with the method of the standard examination manual established by the Japanese Association for the Function Evaluation of Textiles (Sen'i Evaluation Kino, SEK). Standard cotton fabrics were used for unprocessed fabrics, and antibacterial effects were evaluated by comparing the bacteriostatic activity against *S. aureus* ATCC 6538P.

TABLE 1

| Samples | Use of tea polyphenol (% o.w.f.) | Washing cycles | Bacteriostatic activity |
|---|---|---|---|
| Example 1 | THEA-FLAN 30A 3% | 0 | 4.9 |
| Example 1 | THEA-FLAN 30A 3% | 10 | 4.9 |
| Example 2 | Oolong tea concentrate 33% | 10 | 4.4 |
| Example 3 | THEA-FLAN 30A 1% | 10 | 4.7 |
| Example 4 | THEA-FLAN 30A 10% | 10 | 4.2 |
| Example 4 | THEA-FLAN 30A 10% | 60 | 3.9 |

While the values of the evaluation criteria for antibacterial and deodorant processed products in these examinations are 2.2 or higher, values in the treatment according to the present invention were higher than these figures.

Table 2 shows the results of the examination of the deodorant property of the towel and socks produced in Examples 1 to 4 (the assessment of deodorization).

The examination was carried out by placing 1 g of a sample into a five-liter Tedlar bag, supplying the bag with 3 L of ammonia adjusted at its initial concentration of 40 ppm, and determining the ammonia concentration in the bag with a gas detecting tube after standing it 2 hours.

The deodorization ratio was calculated by the following equation:

$$\text{the deodorization ratio (\%)} = (B-A)/B \times 100,$$

wherein

A is the ammonia concentration (ppm) in the bag after 2 hours, and

B is the initial concentration (ppm) of ammonia.

TABLE 2

| Samples | Use of tea polyphenol (% o.w.f.) | Washing cycles | Deodrization (%) |
|---|---|---|---|
| Example 1 | THEA-FLAN 30A 3% | 0 | 100 |
| Example 1 | THEA-FLAN 30A 3% | 10 | 100 |
| Example 2 | Oolong tea concentrate 33% | 10 | 90 |
| Example 3 | THEA-FLAN 30A 1% | 10 | 78 |
| Example 4 | THEA-FLAN 30A 10% | 10 | 98 |
| Example 4 | THEA-FLAN 30A 10% | 60 | 95 |

Table 3 shows the results of color fastness tests of the towel produced in Example 1.

The following color fastness properties were examined:

1. color fastness to light in accordance with JIS L-0842 Grade 3.4,
2. color fastness to washing and laundering in accordance with JIS L-0844 Method A-2(97),
3. color fastness to water in accordance with JIS L-0846,
4. color fastness to sweat in accordance with JIS L-0848 Acid and Alkali, and
5. color fastness to rubbing in accordance with JIS L-0849 Dry and Wet.

TABLE 3

| Particulars | Classification | Result |
|---|---|---|
| Color fastness to light | (grade) | Less than 3 |
| Color fastness to washing and laundering | Color change and fading (grade) | 3 |
| | Staining (grade) cotton | 5 |
| | Staining (grade) silk | 5 |
| Color fastness to water | Color change and fading (grade) | 4–5 |
| | Staining (grade) cotton | 5 |
| | Staining (grade) silk | 5 |
| Color fastness to sweat | Acid | |
| | Color change and fading (grade) | 4–5 |
| | Staining (grade) cotton | 5 |
| | Staining (grade) silk | 5 |
| | Alkaline | |
| | Color change and fading (grade) | 4 |
| | Staining (grade) cotton | 5 |
| | Staining (grade) silk | 5 |
| Color fastness to ribbing | Staining (grade) dry | 5 |
| | wet | 4 |

EXAMPLE 5 (cotton knit dyeing)

10 g sodium hydroxide was dissolved in 5 L water and 35 g of a cationic surfactant containing protein (CIHONTEC Co.) was added thereto. The treating solution was heated at 80° C., into which 100 g of cotton knitted textile was placed and immersed for 30 minutes with stirring.

The cotton knitted textile was removed from the solution and dehydrated, and then immersed for 20 minutes in tea polyphenol solution which was prepared by dissolving 10 g of THEA-FLAN 90S (Ito En, Ltd., 90% of tea polyphenol content) in 1 L water and heating the same at 80° C.

After that, the antibacterial cotton knit containing tea polyphenol was produced by immersing with running water, dehydrating, and drying, according to conventional procedures.

EXAMPLE 6 (regenerated fiber)

100 g of underwear (cellulose fiber (TENCEL®)) was placed in a solution of 8 g sodium hydroxide in 1 L water, followed by adding 40 g of a cationic surfactant containing protein. The mixture was heated at 80° C. and the immersion was performed for 30 minutes with stirring.

The cellulose fiber (TENCEL®) was removed from the solution and dehydrated, and then immersed for 25 minutes in tea polyphenol solution which was prepared by dissolving 10 g of THEA-FLAN 30A (Ito En, Ltd., 40% of tea polyphenol content) in 1 L water and heated at 80 ° C.

After that, the antibacterial underwear containing tea polyphenol was produced by immersing with running water, dehydrating, and drying, according to conventional procedures.

EXAMPLE 7 (continuous dyeing of an open-width fabric)

5 kg of a cationic surfactant containing protein (CIHONTEC Co.) was added to 100 L of a solution in which 1 kg sodium hydroxide was dissolved. The treating solution was heated at 80° C. and contacted continuously with an open-width fabric having 1500 mm in width×50 m on a Zikker dyeing machine.

The fabric was then contacted continuously with tea polyphenol solution which was prepared by dissolving 1 kg of THEA-FLAN 30A (Ito En, Ltd., 40% of tea polyphenol content) in 100 L water and heated at 80° C.

After that, the antibacterial open-width fabric containing tea polyphenol was produced by immersng with running water, dehydrating, and drying, according to conventional procedures.

Tables 4 to 6 show the results of the antibacterial examinations of textile goods produced in Examples 5 to 7. The examination method was the method in accordance with the standard examination manual established by the Japanese Association for the Function Evaluation of Textiles (Sen'i Evaluation Kino, SEK), and antibacterial effects were determined on *Staphylococcus aureus* IFO 12732, Methicillin resistant *Staphylococcus aureus* KB-1005 (MRSA), *Escherichia coli* IFO 3972, *Pseudomonas aeruginosa* IFO 12689, *Klebsiella pneumoniae* IFO 13277. Unprocessed fabrics (standard cotton fabrics) were used as the control.

TABLE 4

| | Strains to be tested | Washing cycles | Initial cells | Cells in the control | Survival cells after 18 hours |
|---|---|---|---|---|---|
| Example 1 | *E. coli* IF03972 | 0 | $1.0 \times 10^5$ | $2.2 \times 10^8$ | not more than 10 |
| | *Ps. aeruginosa* IF012689 | 0 | $1.4 \times 10^5$ | $2.7 \times 10^8$ | not more than 10 |
| | *Kl. pneumoniae* IF013277 | 0 | $1.6 \times 10^5$ | $1.9 \times 10^8$ | not more than 10 |
| | *St. aureus* IF012732 | 0 | $1.6 \times 10^5$ | $3.6 \times 10^7$ | not more than 10 |
| | MRSA | 0 | $1.0 \times 10^5$ | $3.3 \times 10^7$ | not more than 10 |
| Example 1 | *E. coli* IF03972 | 10 | $1.0 \times 10^5$ | $2.2 \times 10^8$ | not more than 10 |
| | *Ps. aeruginosa* IF012689 | 10 | $1.4 \times 10^5$ | $2.7 \times 10^8$ | not more than 10 |
| | *Kl. pneumoniae* IF013277 | 10 | $1.6 \times 10^5$ | $1.9 \times 10^8$ | not more than 10 |
| | *St. aureus* IF012732 | 10 | $1.6 \times 10^5$ | $3.6 \times 10^7$ | not more than 10 |
| | MRSA | 10 | $1.0 \times 10^5$ | $3.3 \times 10^7$ | not more than 10 |

TABLE 5

| | Strains to be tested | Washing cycles | Initial cells | Cells in the control | Survival cells after 18 hours |
|---|---|---|---|---|---|
| Example 2 | *E. coli* IF03972 | 0 | $1.2 \times 10^5$ | $4.2 \times 10^7$ | $3.0 \times 10^6$ |
| | *Ps. aeruginosa* IF012689 | 0 | $1.1 \times 10^5$ | $7.5 \times 10^7$ | $1.8 \times 10^5$ |
| | *Kl. pneumoniae* IF013277 | 0 | $1.0 \times 10^5$ | $1.6 \times 10^7$ | $1.4 \times 10^5$ |
| | *St. aureus* IF012732 | 0 | $1.1 \times 10^5$ | $2.5 \times 10^7$ | $1.9 \times 10^5$ |
| | MRSA | 0 | $1.1 \times 10^5$ | $1.1 \times 10^7$ | $1.3 \times 10^4$ |
| Example 2 | *E. coli* IF03972 | 10 | $1.2 \times 10^5$ | $4.2 \times 10^7$ | $3.1 \times 10^7$ |
| | *Ps. aeruginosa* IF012689 | 10 | $1.1 \times 10^5$ | $7{,}5 \times 10^7$ | $1.9 \times 10^5$ |
| | *Kl. pneumoniae* IF013277 | 10 | $1.0 \times 10^5$ | $1.6 \times 10^7$ | $1.0 \times 10^6$ |
| | *St. aureus* IF012732 | 10 | $1.1 \times 10^5$ | $2.5 \times 10^7$ | $1.6 \times 10^3$ |
| | MRSA | 10 | $1.1 \times 10^5$ | $1.1 \times 10^7$ | not more than 10 |

TABLE 6

| | Strains to be tested | Washing cycles | Initial cells | Cells in the control | Survival cells after 18 hours |
|---|---|---|---|---|---|
| Example 3 | *Kl. pneumoniae IF013277* | 0 | $1.0 \times 10^5$ | $1.6 \times 10^7$ | $1.3 \times 10^7$ |
| | *St. aureus* IF012732 | 0 | $1.1 \times 10^5$ | $2.5 \times 10^7$ | $1.2 \times 10^5$ |
| | MRSA | 0 | $1.1 \times 10^5$ | $1.1 \times 10^7$ | $6.0 \times 10^4$ |
| Example 3 | *Kl. pneumoniae* IF013277 | 10 | $1.0 \times 10^5$ | $1.6 \times 10^7$ | $1.5 \times 10^7$ |
| | *St. aureus* IF012732 | 10 | $1.1 \times 10^5$ | $2.5 \times 10^7$ | $1.9 \times 10^5$ |
| | MRSA | 10 | $1.1 \times 10^5$ | $1.1 \times 10^7$ | $7.0 \times 10^4$ |

What is claimed is:

1. A process for manufacturing an antibacterial fiber, characterized in that fiber is contacted with or immersed in an aqueous solution in which a cationic surfactant with a quaternary ammonium salt group, a water-soluble protein, and an alkaline compound are dissolved; and the fiber is separated from the aqueous solution and immersed in another aqueous solution containing tea polyphenol.

2. The process for manufacturing an antibacterial fiber according to claim 1, characterized in that after the treatment by immersing the fiber in the aqueous solution containing tea polyphenol, the reaction system is neutralized by adding hydroxycarboxylic acid to the aqueous solution containing tea polyphenol.

3. The process for manufacturing an antibacterial fiber according to claim 1, characterized in that the manufactured fiber exerts an antibacterial property against at least one strain selected from the group consisting of *Staphylococcus aureus, Pseudomonas aeruginosa, Escherichia coli*, and *Klebsiella pneumoniae.*

4. The process for manufacturing an antibacterial fiber according to claim 1, characterized in that the manufactured fiber exerts an antibacterial property against *Staphylococcus aureus*, the *Staphylococcus aureus* being resistant to methicillin.

5. The process for manufacturing an antibacterial fiber according to claim 1, characterized in that the aqueous solution containing tea polyphenol is heated at a temperature of 40 to 60° C.

6. The process for manufacturing an antibacterial fiber according to claim 1, characterized in that the tea polyphenol is an extract from at least one tea selected from the group consisting of Japan tea, China tea, black tea, and Pu-erh tea, said tea derived from tea plants of *Camellis sinesis L.*

7. The process for manufacturing a tea antibacterial fiber according to claim 1, characterized in that the fiber is at least one fiber selected from the group consisting of a cellulose fiber, an animal fiber, a polyester fiber, an acetate fiber, a nylon fiber, an acrylic fiber, a rayon fiber, a polypropylene fiber, a polyvinyl chloride fiber, and a polyurethane fiber.

8. The process for manufacturing an antibacterial fiber according to claim 1, characterized in that the fiber is at least one fiber selected from the group consisting of a natural, chemical, synthetic, and regenerated fiber.

9. The process for manufacturing a tea antibacterial fiber according to claim 1, characterized in that the fiber is a fiber structure made of woven fabrics of at least one fiber selected from the group consisting of a natural, chemical, synthetic, and regenerated fiber.

10. A process for manufacturing an antibacterial fiber, characterized in that fiber is contacted with or immersed in an aqueous solution in which a cationic surfactant with a quaternary ammonium salt group, a soluble protein, and an alkaline compound are dissolved; and the fiber is separated from the aqueous solution and immersed in another aqueous solution containing tea polyphenol and a dye.

11. The process for manufacturing an antibacterial fiber according to claim 10, characterized in that after the treatment by immersing the fibers in the aqueous solution containing tea polyphenol and dye, the reaction system is neutralized by adding hydroxycarboxylic acid to the aqueous solution containing tea polyphenol and dye.

12. The process for manufacturing an antibacterial fiber according to claim 10, characterized in that the dye is at least one dye selected from the group consisting of a direct dye, an acid dye, a reactive dye, a disperse dye, an oxidation dye, a food dye, and a pigment resin.

13. The process for manufacturing an antibacterial fiber according to claim 10, characterized in that the manufactured fiber exerts an antibacterial property to at least one strain selected from the group consisting of *Staphylococcus aureus, Pseudomonas aeruginosa, Escherichia coli*, and *Klebsiella pneumoniae.*

14. The process for manufacturing an antibacterial fiber according to claim 10, characterized in that the manufactured fiber exerts an antibacterial property against *Staphylococcus aureus*, the *Staphylococcus aureus* being resistant to methicillin.

15. The process for manufacturing an antibacterial fiber according to claim 10, characterized in that the aqueous solution containing tea polyphenol and dye is heated at a temperature of 40 to 60° C.

16. The process for manufacturing an antibacterial fiber according to claim 10, characterized in that the tea polyphenol is an extract from at least one tea selected from the group consisting of Japan tea, China tea, black tea, and Pu-erh tea, said tea derived from tea plants of *Camellis sinesis L.*

17. The process for manufacturing an antibacterial fiber according to claim 10, characterized in that the fiber is at least one fiber selected from the group consisting of a cellulose fiber, an animal fiber, a polyester fiber, an acetate fiber, a nylon fiber, an acrylic fiber, a rayon fiber, a polypropylene fiber, a polyvinyl chloride fiber, and a polyurethane fiber.

18. The process for manufacturing an antibacterial fiber according to claim 10, characterized in that the fiber is at least one fiber selected from the group consisting of a natural, chemical, synthetic, and regenerated fiber.

19. The process for manufacturing an antibacterial fiber according to claim 10, characterized in that the fiber is a fiber structure made of woven fabrics of at least one fiber selected from the group consisting of a natural, chemical, synthetic, and regenerated fiber.

* * * * *